US011802480B2

(12) United States Patent
Graves et al.

(10) Patent No.: US 11,802,480 B2
(45) Date of Patent: Oct. 31, 2023

(54) DETERMINATION OF DOWNHOLE CONDITIONS USING CIRCULATED NON-FORMATION GASSES

(71) Applicant: Halliburton Energy Services, Inc., Houston, TX (US)

(72) Inventors: W. V. Andrew Graves, Lafayette, LA (US); Mathew D. Rowe, Lafayette, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 607 days.

(21) Appl. No.: 15/126,517

(22) PCT Filed: Apr. 15, 2014

(86) PCT No.: PCT/US2014/034112

§ 371 (c)(1),
(2) Date: Sep. 15, 2016

(87) PCT Pub. No.: WO2015/160328

PCT Pub. Date: Oct. 22, 2015

(65) Prior Publication Data

US 2017/0096893 A1 Apr. 6, 2017

(51) Int. Cl.
*E21B 49/00* (2006.01)
*E21B 49/08* (2006.01)
(Continued)

(52) U.S. Cl.
CPC ..... *E21B 49/005* (2013.01); *E21B 21/062* (2013.01); *E21B 21/067* (2013.01); *E21B 47/11* (2020.05); *E21B 49/088* (2013.01)

(58) Field of Classification Search
CPC .... E21B 49/005; E21B 21/062; E21B 21/067; E21B 49/088
See application file for complete search history.

(56) References Cited

U.S. PATENT DOCUMENTS 4,123,937 A 11/1978 Alexander
5,070,949 A * 12/1991 Gavignet ..... E21B 21/08 175/48

(Continued)

FOREIGN PATENT DOCUMENTS

WO 1994/027118 A1 11/1994
WO 2006/094669 A1 9/2006
WO 2012/128921 A2 9/2012

OTHER PUBLICATIONS

International Preliminary Report on Patentability issued in related Application No. PCT/US2014/034112, dated Oct. 27, 2016 (11 pages).

(Continued)

*Primary Examiner* — Tara Schimpf
*Assistant Examiner* — Neel Girish Patel
(74) *Attorney, Agent, or Firm* — Kilpatrick Townsend & Stockton LLP

(57) ABSTRACT

An example method for determining downhole conditions in a subterranean formation during a drilling operation may include introducing non-formation gas into a flow of drilling fluid through a fluid conduit in fluid communication with a drill string disposed within a borehole in the subterranean operation. The non-formation gas may be received from the flow of drilling fluid through a return line in fluid communication with the borehole. A downhole condition may be determined based, at least in part, on the received non-formation gas.

20 Claims, 6 Drawing Sheets

(51) Int. Cl.
*E21B 47/11* (2012.01)
*E21B 21/06* (2006.01)

(56) References Cited

U.S. PATENT DOCUMENTS 5,277,263 A * 1/1994 Amen ..... E21B 49/005 175/42
6,585,044 B2 7/2003 Rester et al.
7,284,604 B2 10/2007 Robertson et al.
7,571,644 B2 8/2009 Ibrahim et al.
2003/0079912 A1* 5/2003 Leuchtenberg ..... E21B 44/00 175/48
2004/0193375 A1* 9/2004 Dong ..... E21B 47/10 702/13
2005/0149264 A1 7/2005 Tarvin et al.
2007/0050154 A1 3/2007 Albahri
2008/0190663 A1* 8/2008 Stave ..... E21B 21/08 175/7
2009/0008560 A1* 1/2009 Gunn ..... G01N 21/3504 250/343
2009/0288840 A1* 11/2009 Eriksen ..... E21B 21/106 166/377
2010/0133007 A1* 6/2010 Sehsah ..... E21B 44/00 175/25
2010/0139386 A1* 6/2010 Taylor ..... E21B 47/11 73/152.23
2010/0175467 A1 7/2010 DiFoggio et al.
2010/0198533 A1* 8/2010 Peacock ..... E21B 47/11 702/182
2011/0094736 A1 4/2011 Evrard
2012/0228027 A1 9/2012 Sehsah
2012/0234599 A1* 9/2012 Brumboiu ..... E21B 21/062 175/50
2013/0186688 A1 7/2013 Rasmus et al.
2014/0076636 A1* 3/2014 Johnson ..... E21B 21/16 175/71
2014/0209384 A1* 7/2014 Hanson ..... G01F 1/704 175/42
2014/0316705 A1* 10/2014 Zuo ..... G01V 8/10 702/6
2015/0039275 A1* 2/2015 Mikhailov ..... E21B 43/00 703/2
2015/0041213 A1* 2/2015 Jeffryes ..... E21B 17/18 175/25

OTHER PUBLICATIONS

International Search Report and Written Opinion issued in PCT Application No. PCT/US2014/034112 dated Jan. 8, 2015, 14 pages.

* cited by examiner

DETERMINATION OF DOWNHOLE CONDITIONS USING CIRCULATED NON-FORMATION GASSES

CROSS-REFERENCE TO RELATED APPLICATION

The present application is a U.S. National Stage Application of International Application No. PCT/US2014/034112 filed Apr. 15, 2014, which is incorporated herein by reference in its entirety for all purposes.

BACKGROUND

Subterranean wells consist of a borehole that is drilled into a rock formation to reach a target portion of the formation. The boreholes may stretch thousands of feet below the surface through many different types of rock in different temperature and pressure conditions. Due to the different types of rock and the different temperature and pressure conditions, the borehole may have a non-uniform shape throughout its length, with the shape of the borehole in a given location potentially changing over time due to caves-ins, fluid and gas flows, etc. Knowledge of the conditions in the borehole may aide in future determinations with respect to the drilling and completion process.

FIGURES

Some specific exemplary embodiments of the disclosure may be understood by referring, in part, to the following description and the accompanying drawings.

Figure 1:
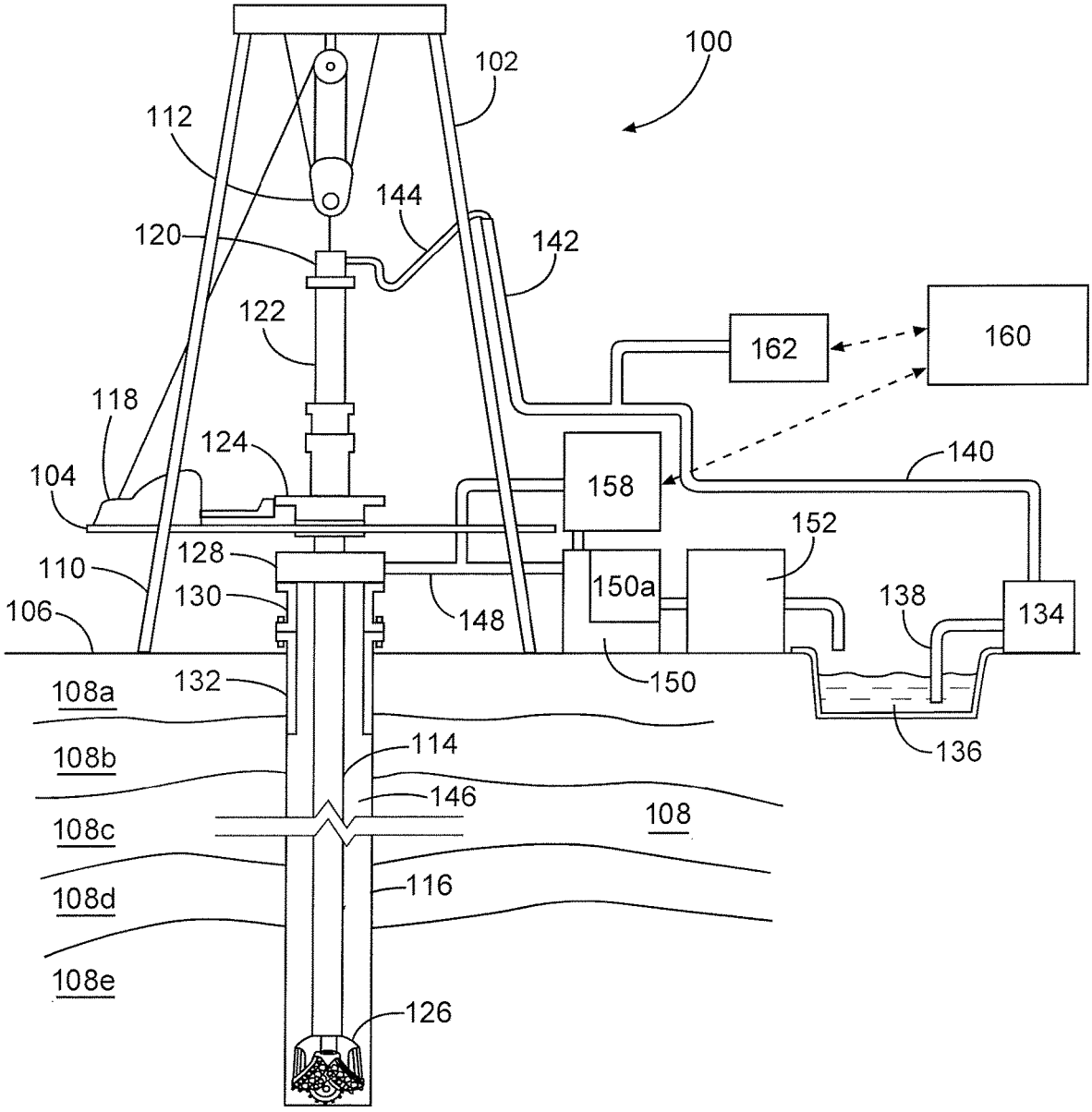
FIG. 1 is a diagram of an example drilling system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to a determination of downhole conditions using circulated non-formation gasses.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to drilling operations that include, but are not limited to, target (such as an adjacent well) following, target intersecting, target locating, well twinning such as in SAGD (steam assist gravity drainage) well structures, drilling relief wells for blowout wells, river crossings, construction tunneling, as well as horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, stimulation wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

Modern petroleum drilling and production operations demand information relating to parameters and conditions downhole. Several methods exist for downhole information collection, including logging-while-drilling ("LWD") and measurement-while-drilling ("MWD"). In LWD, data is typically collected during the drilling process, thereby avoiding any need to remove the drilling assembly to insert a wireline logging tool. LWD consequently allows the driller to make accurate real-time modifications or corrections to optimize performance while minimizing downtime. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Thus, if a first device communicatively couples to a second device, that connection may be through a direct connection, or through an indirect communication connection via other devices and connections. The indefinite articles "a" or "an," as used herein, are defined herein to mean one or more than one of the elements that it introduces. The terms "gas" or "fluid," as used herein, are not limiting and are used interchangeably to describe a gas, a liquid, a solid, or some combination of a gas, a liquid, and/or a solid.

FIG. 1 is a diagram illustrating an example drilling system 100, according to aspects of the present disclosure. In the embodiment shown, the system 100 comprises a derrick 102 mounted on a floor 104 that is in contact with the surface 106 of a formation 108 through supports 110. The formation 108 may be comprised of a plurality of rock strata 108*a-e*, each of which may be made of different rock types with different characteristics. At least some of the strata 108*a-e* may be porous and contain trapped liquids and gasses. Although the system 100 comprises an "on-shore" drilling system in which floor 104 is at or near the surface, similar "off-shore" drilling systems are also possible and may be characterized by the floor 104 being separated by the surface 106 by a volume of water.

The derrick 102 may comprise a traveling block 112 for raising or lowering a drill string 114 disposed within a borehole 116 in the formation 108. A motor 118 may control the position of the traveling block 112 and, therefore, the drill string 114. A swivel 120 may be connected between the traveling block 112 and a kelly 122, which supports the drill string 114 as it is lowered through a rotary table 124. A drill bit 126 may be coupled to the drill string 114 and driven by a downhole motor (not shown) and/or rotation of the drill string 114 by the rotary table 124. As bit 126 rotates, it creates the borehole 116, which passes through one or more rock strata or layers of the formation 108.

The drill string 114 may extend downwardly through a bell nipple 128, blowout preventer (BOP) 130, and wellhead 132 into the borehole 116. The wellhead 132 may include a portion that extends into the borehole 116. In certain embodiments, the wellhead 132 may be secured within the borehole 116 using cement. The BOP 130 may be coupled to the wellhead 132 and the bell nipple 128, and may work with the bell nipple 128 to prevent excess pressures from the formation 108 and borehole 116 from being released at the surface 106. For example, the BOP 130 may comprise a ram-type BOP that closes the annulus between the drill string 114 and the borehole 116 in case of a blowout.

During drilling operations, drilling fluid, such as drilling mud, may be pumped by a mud pump 134 from a reservoir 136 through a suction line 138. The drilling mud may flow from the mud pump 134 into the drill string 114 at the swivel 120 through one or more fluid conduits, including pipe 140, stand-pipe 142, and hose 144. The drilling mud then may flow downhole through the drill string 114, exiting at the drill bit 126 and returning up through an annulus 146 between the drill string 114 and the borehole 116 in an open-hole embodiments, or between the drill string 114 and a casing (not shown) in a cased borehole embodiment. While in the borehole 116, the drilling mud may capture fluids and gasses from the formation 108 as well as particulates or cuttings that are generated by the drill bit 126 engaging with the formation 108.

The bell nipple 128 may be in fluid communication with the annulus 146, and drilling mud may flow through the annulus 146 to the bell nipple 128 where it exits though a return line 148. The return line 148 may be coupled to one or more fluid treatment mechanisms, and provide fluid communication between the annulus 146 and the fluid treatment mechanisms. The fluid treatment mechanisms may separate the particulates from the returning drilling mud before returning the drilling mud to the reservoir 136, where it can be recirculated through the drilling system 100. In the embodiment shown, the fluid treatment mechanisms may comprise a mud tank 150 (which may also be referred to as a header box or possum belly) and a shale shaker 152. The mud tank 150 may receive the flow of drilling mud from the annulus 146 and slow it so that the drilling mud does not shoot past the shale shaker 152. The mud tank 150 may also allow for cuttings to settle and gasses to be released. In certain embodiments, the mud tank 150 may comprise a gumbo trap or box 150*a*, that captures heavy clay particulates before the drilling mud moves to the shale shaker 152, which may separate fine particulates from the drilling mud using screens. The drilling mud may flow from the fluid treatment mechanisms into the reservoir 136 through fluid conduit 154.

The system 100 may further include at least one gas extractor and analyzer 158 that is in fluid communication with drilling fluid as it cycles through the drilling system 100. Although the extractor and analyzer 158 is described herein with combined extraction and analysis functionality, the extraction and analysis functionality may be provided in separate systems that are coupled together or are otherwise in fluid communication. In the embodiment shown, the extractor and analyzer 158 may be in fluid communication with and receive samples of the drilling fluid through a probe connected to the return line 148. The samples may comprise a continuous flow of drilling fluid or discrete volumes taken either continuously or at time intervals. While within the extractor and analyzer 158, gas suspended within the drilling fluid sample may be extracted from the drilling fluid sample. Example gas extraction mechanisms include, but are not limited to, continuously stirred vessels, distillation columns, flash columns, separator columns, or any other vessel that allows for the separation and expansion of gas from liquids and solids. The liquid portion of the drilling fluid sample, to the extent it is not destroyed during the extraction process, may be returned to regular the flow of drilling fluid, such as through a pipe or other fluid communication channel between the extractor and analyzer 158 and the mud tank 150. The gas may be extracted from the drilling fluid sample using gas extraction techniques that would be appreciated by one of ordinary skill in the art in view of this disclosure, such as constant volume extractions and enhanced alkane gas liberation and extraction. The total volume and/or mass of extracted gas may be known for each sample.

In certain embodiments, the extractor and analyzer 158 may continuously extract gas from the drilling fluid samples and analyze the extracted gas from the drilling fluid sample to determine the chemical composition of the gas. The gas analysis may be performed, for example, using gas chromatography, mass spectrometry, or infrared analysis systems within the extractor and analyzer 158 that receive or are otherwise in communication with the extracted gas. Determining the chemical composition may comprise determining the types and amounts of gasses within the extracted gas as well as the relative percentages. In certain embodiments, only some of the drilling fluid sample and extracted gas may be tested by the extractor and analyzer 158, with the remainder being released back into the flow of drilling fluid for the drilling system 100.

The gas analysis from the extractor and analyzer 158 may result in electrical output signals that can be processed either by an information handling system at the extractor and analyzer 158 or at a separate information handling system. In the embodiment shown, the system 100 comprises an information handling system 160 communicably coupled to the extractor and analyzer 158, such as through a wireless or wired communications channel. The information handling system 160 may be located on-site with the system 100 or remotely, in which case the electrical signals output by the extractor and analyzer 158 may be communicated to the information handling system 160 through the internet, local- or wide-area networks, or on a storage medium physically transported to the information handling system 160. The information handling system 160 may comprise a processor and a memory device communicably coupled to the processor containing a set of instructions that, when executed by the processor, cause the processor to receive the output signals from the extractor and analyzer 158, determine the chemical composition of the extracted gas, and determine at least one downhole condition based, at least in part, on the determined chemical composition.

According to aspects of the present disclosure, the extractor and analyzer 158 may be used in conjunction with a gas injector 162 of the drilling system 100 to identify and track downhole conditions with respect to the borehole 116 and the formation 108. Example downhole conditions include, but are not limited to, fluid loss within the formation and under pressure. Downhole conditions may also include downhole physical characteristics, such as the volume of the borehole 116, which may aide in the determination of well stability, proper drilling fluid management, the determination of accurate cement volumes to secure downhole casing, and the accurate correlation of extracted gasses to formation strata.

In the embodiment shown, the gas injector 162 may be in fluid communication with the flow of drilling fluid into the drill string 144, such as at the pipe 140, and inject a non-formation gas into the drilling fluid that may be extracted from a drilling fluid sample and analyzed along with formation gasses at the extractor and analyzer 158. The gas injector 162 may contain, for example, a reservoir or tank of non-formation gas (not shown) from which a known mass or volume of non-formation gas can be pumped or injected into the flow of drilling fluid. As used herein, non-formation gas may comprise a gas with a known chemical composition that is not found or is not likely to be found in a formation being drilled. In contrast, formation gas may comprise gasses that are or are likely to be trapped within the formation being drilled or otherwise produced as part of the drilling process, examples of which include methane. Although the gas injector 162 is shown coupled to the pipe 140, it may be coupled to other elements associated with the flow of drilling fluid, including, but not limited to, the stand pipe 142 and hose 144.

In certain embodiments, the gas injector 162 may be communicably coupled to the information handling system 160 or to another information handling system that may control when to inject the non-formation gas and the amount of non-formation gas to inject. In other embodiments, the gas injector 162 may comprise a local controller or information handling system that controls the gas injection and/or responds to commands or control signals from a second information handling system. In certain embodiments, the gas injector 162 may comprise valves and pumps that may be controlled to inject known volumes and/or masses of non-formation gasses at time intervals, with the known volumes and/or masses being calculated based on conditions in the flow of drilling fluid, as will be described below.

In use, the gas injector 162 may introduce a known volume or mass of non-formation gas into the flow of drilling fluid, which may be flowing with a known flow rate, creating a liquid/gas suspension that is pumped into the borehole 116 through the drill string 114 and drill bit 126 and returns to the surface in the annulus 146, where it may receive other fluids and gasses from the formation 108 or lose fluids and gasses to the formation 108. Accordingly, the drilling fluid that returns to the surface 106 through the annulus 146 may include a liquid/gas suspensions with formation gasses, non-formation gasses, drilling fluid, and formation fluids. Samples of the suspension may be received at the extractor and analyzer 158, which may extract the suspended gasses from the sample and determine a chemical composition of the gasses, including the amount and/or relative percentage of the non-formation gas in the sample. In certain embodiments, the extractor and analyzer 158 may continuously sample the drilling fluid and track the amount or relative percentage of non-formation gas over time, resulting in a curve that can be mathematically analyzed to determine one or more downhole conditions, including, but not limited to, the volume of the annulus 146, the volume of a complete circulation through the borehole 116, the final volume of the borehole 116 or section of the borehole 116, the percentage of the borehole 116 that is washed out or caved in, and the efficiency of the pump 134. Additionally, the determined amount and/or relative percentage of the non-formation gas received at the surface 106 may be processed and compared to the amount injected into the drilling fluid at the gas injector 162 to determine a difference between the amount of non-formation gas injected and the amount received at the surface after the liquid/gas suspension traveled through the borehole.

Figure 2:
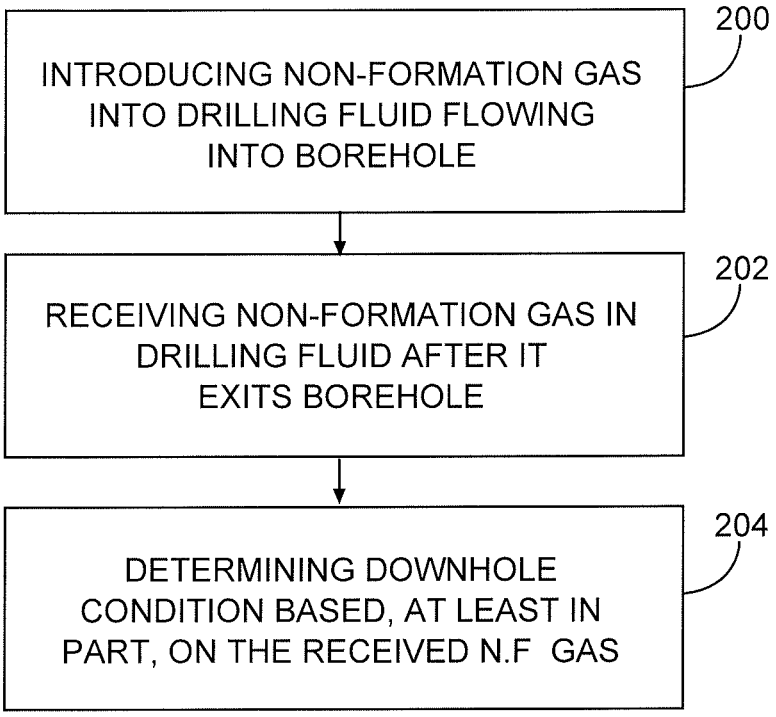
FIG. 2 is a diagram of an example method for determining downhole conditions using circulated non-formation gas, according to aspects of the present disclosure.

FIG. 2 is a flow diagram of an example method for determining downhole conditions using circulated non-formation gas, according to aspects of the present disclosure. Step 200 comprises introducing non-formation gas into drilling fluid flowing into a borehole. The non-formation gas may be introduced into the drilling fluid using a gas injector, as described above, and the introduced non-formation gas may comprise either known or unknown volumes or masses of non-formation gas. In certain embodiments, the gas may be introduced into the drilling fluid as close as possible to where the drilling fluid enters the borehole, to reduce the amount of non-formation gas that may be lost into the atmosphere. With respect to the drilling system described above, the gas may be introduced, for example, in a stand-pipe or a hose between the stand-pipe and a swivel.

Step 202 comprises receiving non-formation gas from the drilling fluid after it exits the borehole. Receiving the gas may comprise receiving the drilling fluid in which the gas is suspended and/or extracting gasses from the drilling fluid, of which the non-formation gas is a portion. In certain embodiments, the non-formation gas may be received from the drilling fluid as soon as reasonably possible after the drilling fluid exits the borehole, to reduce the amount of gas that may be lost from the drilling fluid into the atmosphere. With respect to the drilling system described above, the non-formation gas may be received from the return line near the bell nipple. The non-formation gas may be received at a gas extractor and analysis unit, for example, that may extract and characterize the non-formation gas. In certain embodiments, as described above, a gas analyzer may continuously or periodically sample the drilling fluid, extract gas from the samples, determine percentages of the extracted gas corresponding to the non-formation gas; and plot the percentage over time. Example plots are described below with respect to FIGS. 4A and 4B.

Step 204 comprises determining a downhole condition based, at least in part, on the received non-formation gas. Determining the downhole condition based, at least on part, on the received non-formation gas may comprise mathematically analyzing the plot corresponding to the percentages of non-formation gas in the extracted gas over time. In certain embodiments, the mathematical analysis may comprise curve fitting using equations and functions that include but are not limited to Gaussian, Lorentzian, polynomial, power law, and logarithmic functions. The functions may be fitted, for example, using a sum of least squares technique or any other technique that would be appreciated by one of ordinary skill in the art in view of this disclosure. Curve fitting applications may be particularly useful to determine downhole physical conditions, such as the volume or a borehole or annulus and derivations from normality.

Figure 3:
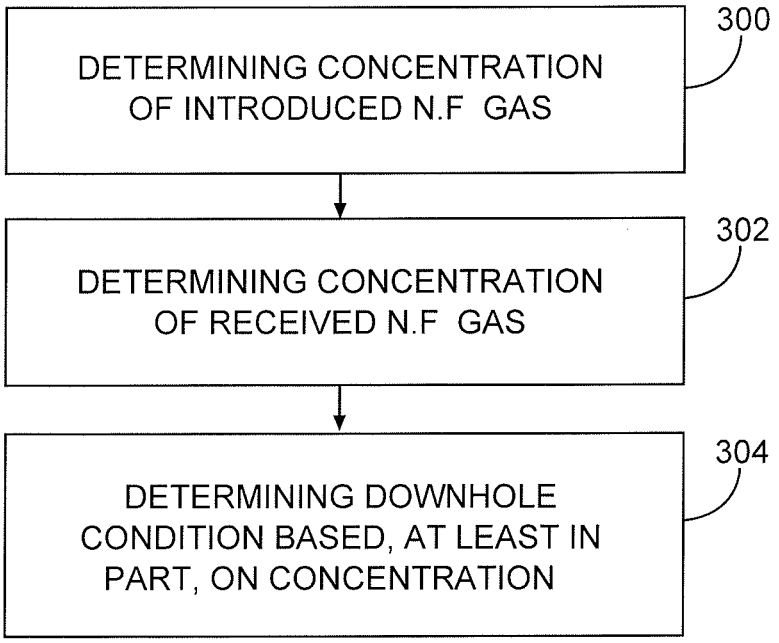
FIG. 3 is a diagram of an example method for determining downhole conditions using circulated non-formation gas, according to aspects of the present disclosure.

In certain embodiments, the mathematical analysis may comprise numerical integration to determine volumes or masses of the received non-formation gas, which then may be used to determine a non-formation gas concentration in a volume of drilling fluid and downhole conditions based on the determined concentration. FIG. 3 is a flow diagram of an example method for determining downhole conditions using numerical integration, according to aspects of the present disclosure. Step 300 comprises determining a concentration of the introduced non-formation gas in the flow of drilling fluid. The concentration may take the form of a percentage, for example, or in the form of a parts per million (ppm) determination. With respect to the concentration of the non-formation gas introduced into the flow of drilling fluid into the borehole, if the volume of non-formation gas is known, the following equation may be used to determine the concentration in ppm:

$$\text{ppmv}_1 = V_1/(F_{DF} * T_1) * 1{,}000{,}000$$

where $\text{ppmv}_1$ comprises the ppm of the non-formation gas introduced into the drilling fluid based on a known volume of non-formation gas as the drilling fluid flows downhole; $V_1$ comprises the known volume of the non-formation gas; $F_{DF}$ comprises the flow rate of the drilling fluid into which the non-formation gas is injected; and $T_1$ comprises the total time it took to introduce the non-formation gas into the drilling fluid. In contrast, if the mass of the non-formation gas is known, the following equation may be used to determine the concentration of non-formation gas in ppm:

$$\text{ppmm}_1 = M_1/(F_{DF} * D_{DF} * T_1) * 1{,}000{,}000$$

where $\text{ppmm}_1$ comprises the ppm of the non-formation gas introduced into the drilling fluid based on a known mass of non-formation gas as the drilling fluid flows downhole; $M_1$ comprises the known mass of the non-formation gas; $F_{DF}$ comprises the flow rate of the drilling fluid into which the non-formation gas is introduced; $D_{DF}$ comprises the density of the drilling fluid into which the non-formation gas is introduced; and $T_1$ comprises the total time it took to introduce the non-formation gas into the drilling fluid.

Step 302 comprises determining a concentration of the received non-formation gas within the returning drilling fluid. This may comprise extracting and analyzing non-formation gasses from samples of the returning drilling fluid, as described above. As is also described above, measuring the non-formation gas may comprise determining and plotting relative percentages of the non-formation gas in the continuous gas samples over time with respect to the other extracted gasses. Where the volume or mass of each sample is known, the plotted relative percentage of non-formation gas may correspond to volumes or masses of the non-formation gas. In those embodiments, determining a concentration of the received non-formation gas in the drilling fluid may comprise numerically integrating the plot over a requisite time period, which may comprise the entire time period in which non-formation gas is detected, for example, or multiple time periods centered on peaks in the amount of received non-formation gas, as will be described below.

With respect to the concentration of the received non-formation gas, if the volume of the received non-formation gas is known or determined using numerical integration, the following equation may be used to determine the concentration of received non-formation gas in the drilling fluid in ppm:

$$\text{ppmv}_2 = C_V/(F_{DF} * T_D) * 1{,}000{,}000$$

where $\text{ppmv}_2$ comprises the ppm of the received non-formation gas in a drilling fluid volume; $C_V$ comprises the volume of the received non-formation gas; $F_{DF}$ comprises the flow rate of the drilling fluid from which the received non-formation gas was extract; and $T_D$ comprises the total time that samples of the drilling fluid were taken to extract the non-formation gas. In contrast, if the mass of the received non-formation gas is known or determined using numerical integration, the following equation may be used to determine the concentration of received non-formation gas in the drilling fluid in ppm:

$$\text{ppmm}_2 = C_M/(F_{DF} * D_{DF} * T_D) * 1{,}000{,}000$$

where $\text{ppmm}_2$ comprises the ppm of the received non-formation gas in the drilling fluid volume; $C_M$ comprises the mass of the received non-formation gas; $F_{DF}$ comprises the flow rate of the drilling fluid from which the received non-formation gas was extracted; $D_{DF}$ comprises the density of the drilling fluid from which the received non-formation gas was extracted; and $T_D$ comprises the total time that samples of the drilling fluid were taken to extract the non-formation gas.

Step 304 comprises determining the downhole condition based at least in part on the introduced gas concentration and the received gas concentration. In certain embodiments, determining the downhole condition based at least in part on the introduced gas concentration and the received gas concentration may comprise comparing the introduced gas concentration to the received gas concentration. Comparing the introduced gas concentration and the received gas concentration may comprise determining a ratio between the introduced gas concentration to the received gas concentration. Where the received non-formation gas concentration is based on a total mass or volume of the received non-formation gas, rather than only a portion, as will be described below, the ratio may comprise a fluid loss percentage that corresponds to a percentage of drilling fluid that is lost to the formation. Example loss percentages may be determined using ($ppmv_2/ppmv_i$) or ($ppmm_2/ppmm_l$), depending on how the concentrations were determined. In certain embodiments, an approximate raw value for the amount of fluid lost to the formation may be determined by multiple the loss percentage by a known flow rate of the drilling fluid. In certain embodiments, the concentrations, loss percentages, and fluid loss may be adjusted to account for non-formation gas losses where the non-formation gas is introduced or received from the drilling fluid.

Figure 4A:
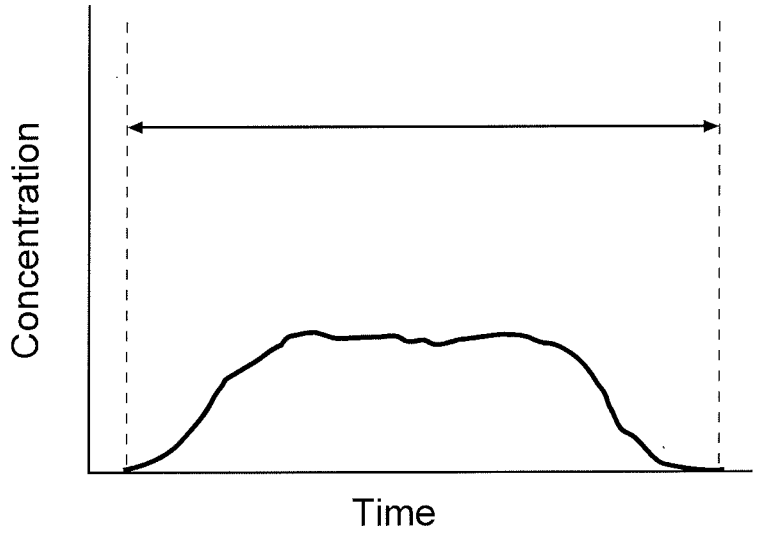
FIGS. 4A and 4B are example plots representing the relative concentrations of non-formation gas with respect to the gasses extracted from returning drilling fluid, according to aspects of the present disclosure.
Figure 4B:
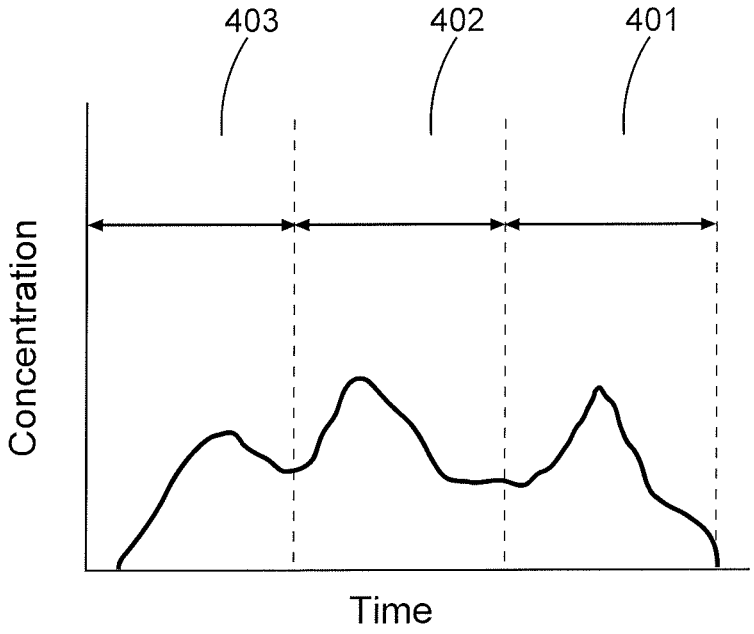

FIGS. 4A and 4B illustrate example plots representing the relative percentages of non-formation gas with respect to the gasses extracted from returning drilling fluid, according to aspects of the present disclosure. As can be seen, the plot of the relative concentration may comprise a smooth plot or a plot with multiple peaks. In both instances, the plot may be numerically integrated over the time period in which non-formation gas is present to determine a total mass or volume of the non-formation gas, which can in turn be used to determine a loss percentage, described above. In certain embodiments, however, multiple numerical integrations may occur when peaks are present, as is shown in FIG. 4B. These peaks may be of interest, because they may correspond to wash-out portions of the borehole, where there is a widened portion of the borehole that temporarily traps gas. The peaks may also correspond to under balance conditions in the borehole, where the formation is releasing fluids and gasses into the drilling fluid within the borehole.

In FIG. 4B, numerical integrations may occur with respect to portions 401, 402, and 403 of the plot, with each integration corresponding to a total volume or mass of non-formation gas (e.g., $C_{401}$, $C_{402}$, and $C_{403}$) within the time period of integration. Each of the values $C_{401}$, $C_{402}$, and $C_{403}$ may be used in the equations above to determine concentrations within corresponding volumes of the drilling fluid, and the concentrations may be compared to the concentration of the introduced non-formation fluid to determine the percentage of the received non-formation gas corresponding to each of the peaks, as well as the raw total volume or mass associated with each peak. In certain embodiments, the wash-out with respect to each peak may be associated with a depth of the borehole based, for example, on lag time and the presence of booster pumps, reamers, bits, and diverters, allowing for both the size and location of the wash out to be determined.

Figure 5:
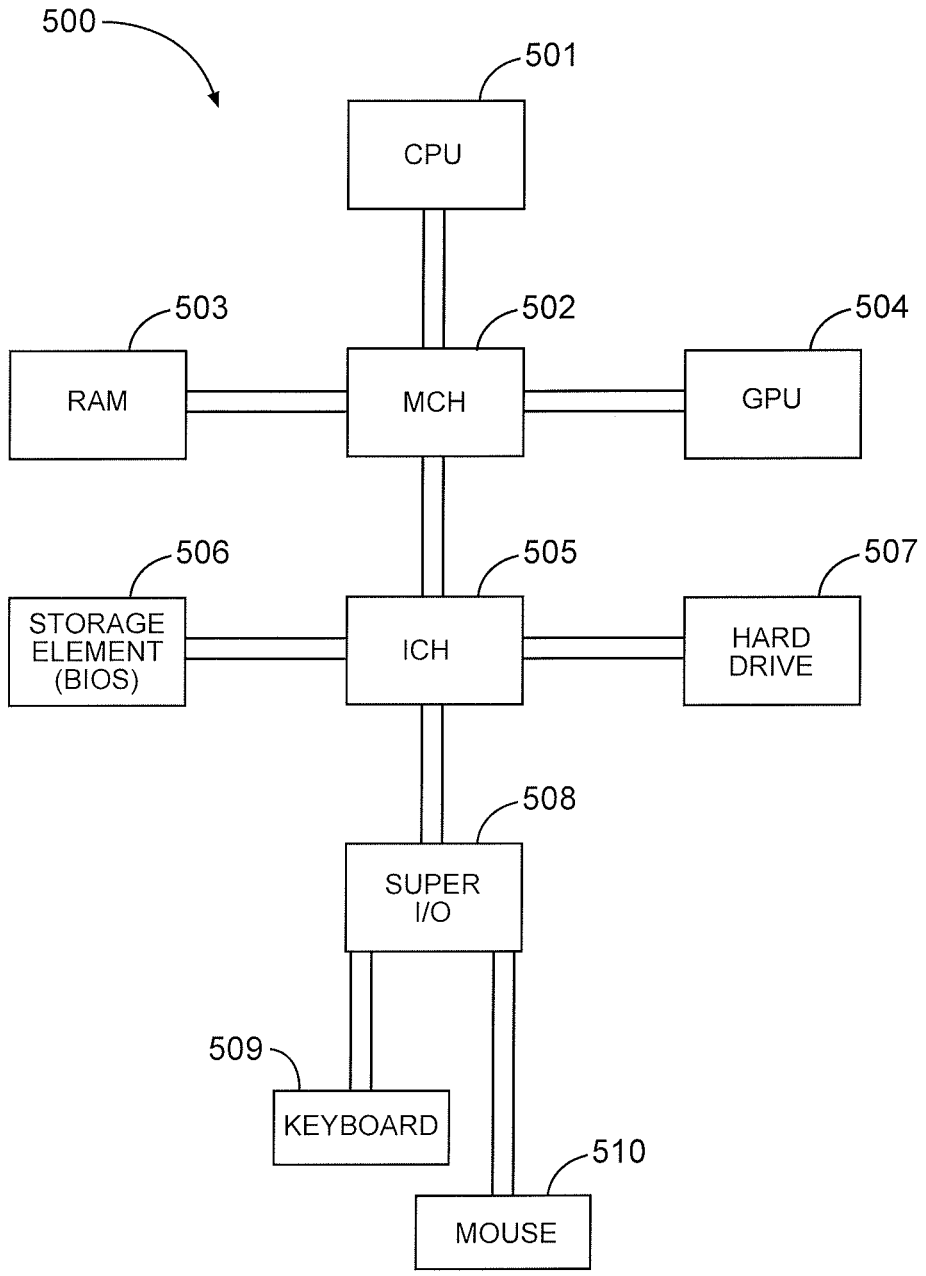
FIG. 5 is a block diagram of an example information handling system, according to aspects of the present disclosure.

FIG. 5 is a block diagram showing an example information handling system 500 that may be used in conjunction with the systems and methods described above, according to aspects of the present disclosure. A processor or CPU 501 of the information handling system 500 is communicatively coupled to a memory controller hub or north bridge 502. Memory controller hub 502 may include a memory controller for directing information to or from various system memory components within the information handling system, such as RAM 503, storage element 506, and hard drive 507. The memory controller hub 502 may be coupled to RAM 503 and a graphics processing unit 504. Memory controller hub 502 may also be coupled to an I/O controller hub or south bridge 505. I/O hub 505 is coupled to storage elements of the computer system, including a storage element 506, which may comprise a flash ROM that includes a basic input/output system (BIOS) of the computer system. I/O hub 505 is also coupled to the hard drive 507 of the computer system. I/O hub 505 may also be coupled to a Super I/O chip 508, which is itself coupled to several of the I/O ports of the computer system, including keyboard 509 and mouse 510. In certain embodiments, the Super I/O chip may also be connected to and receive input from a gas extractor and analyzer and/or a gas injector, similar to those described above. Additionally, at least one memory component of the information handling system 500, such as the hard drive 507, may contain a set of instructions that, when executed by the processor 501, cause the processor 501 to perform certain actions with respect to outputs received from a gas extractor and analyzer, such as determine a chemical composition of extracted gas and a downhole condition based, at least in part, on the determined chemical composition.

Figure 6:
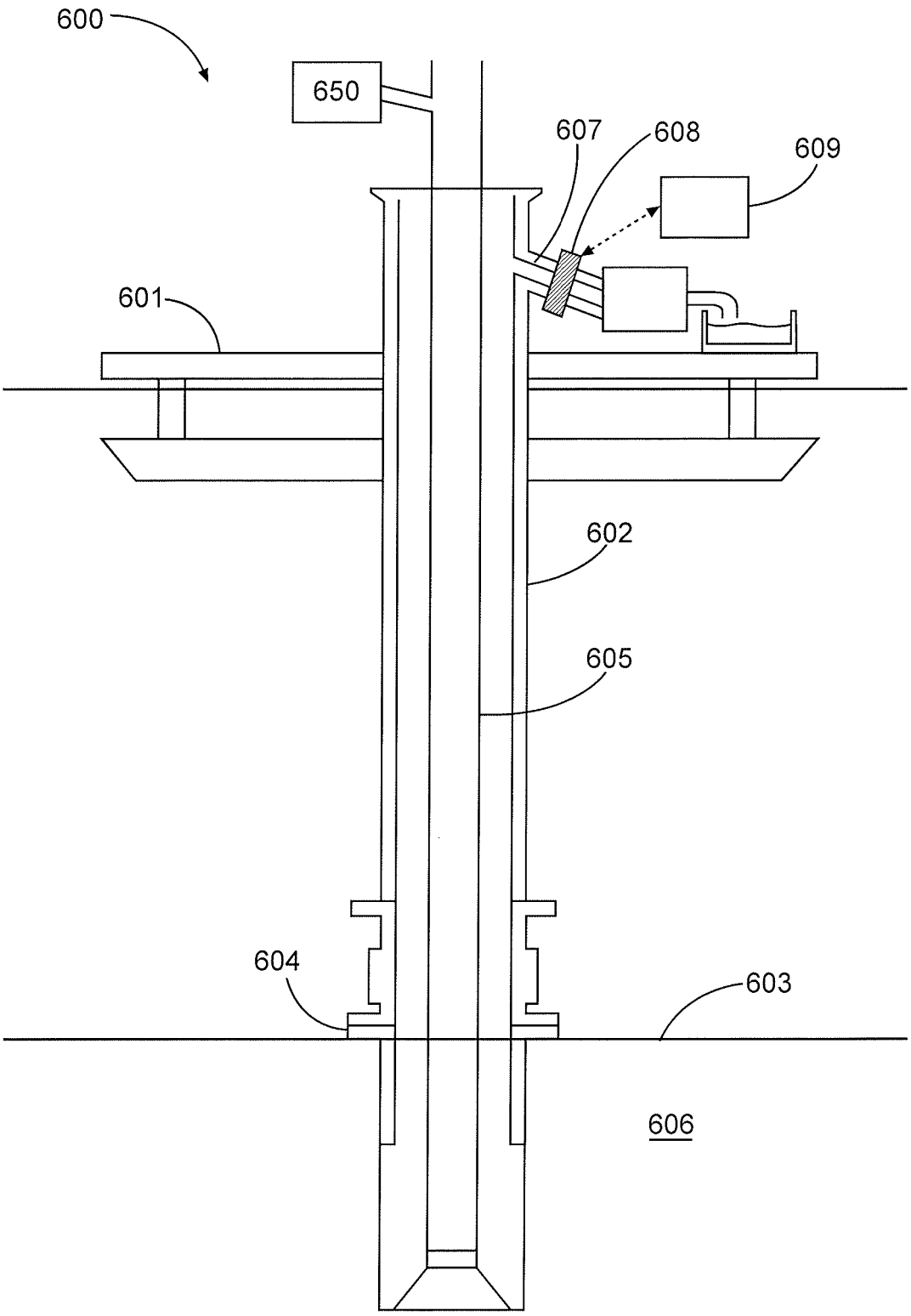
FIG. 6 is a diagram of an example offshore drilling system, according to aspects of the present disclosure.

Although the gas injector, extractor, and analyzer have been described herein in the context of a conventional drilling assembly positioned at the surface, the system may similarly be used with different drilling assemblies (e.g., wirelines, slickline, etc.) in different locations. FIG. 6 is a diagram of an offshore drilling system 600, according to aspects of the present disclosure. As can be seen, portions of the drilling system 600 may be positioned on a floating platform 601. A tubular 602 may extend from the platform 601 to the sea bed 603, where the well head 604 is located. A drill string 605 may be positioned within the tubular 602, and may be rotated to penetrate the formation 606. Drilling fluid may be circulated downhole within the drill string 605 and return to the surface in an annulus between the drill string 605 and the tubular 602. Non-formation gas may be introduced into the drilling fluid with a gas injector 650. A proximal portion of the tubular 602 may comprise a fluid conduit 607 coupled thereto. The fluid conduit 607 may function as a fluid return, and a gas extractor and analyzer 608 may be coupled to the fluid conduit 607 and/or in fluid communication with a drilling fluid within the fluid conduit 607. Likewise, the gas injector 650 and extractor and analyzer 608 may be communicably coupled to an information handling system 609 positioned on the platform 601.

Figure 7:
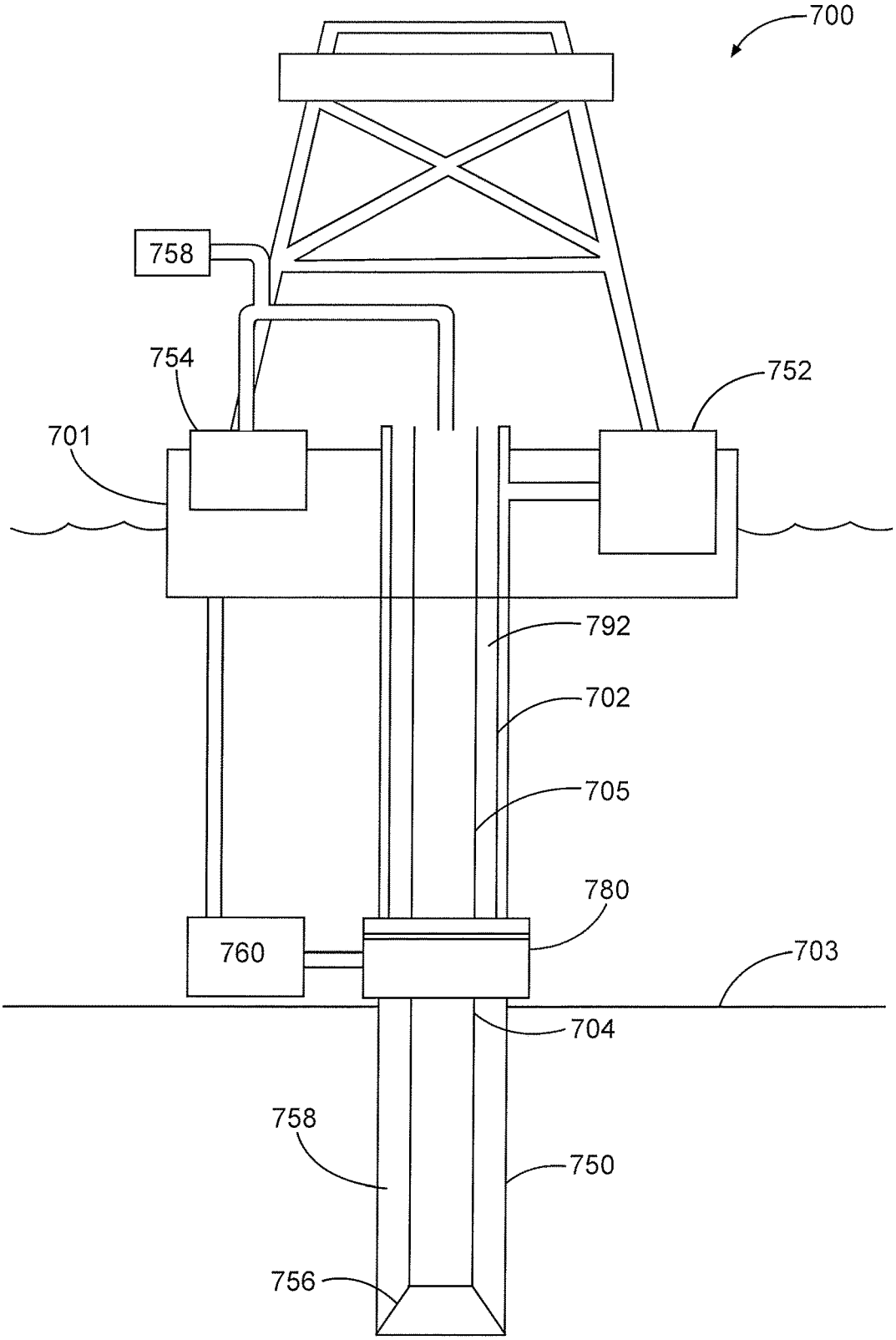
FIG. 7 is a diagram of an example offshore drilling system, according to aspects of the present disclosure.

FIG. 7 is a diagram of a dual gradient offshore drilling system, according to aspects of the present disclosure. As can be seen, portions of the drilling system 700 may be positioned on a floating boat or platform 701. A riser 702 may extend from the platform 701 to the sea bed 703, where the well head 704 is located. A drill string 705 may be positioned within the riser 702 and a borehole 750 within the formation 706. The drill string 705 may pass through a sealed barrier 780 between the riser 702 and the borehole 705. The annulus 792 surrounding the drill string 705 within the riser 702 may be filled with sea water, and a first pump 752 located at the surface may circulate sea water within the riser 702. A second pump 754 positioned at the platform 701 may pump drilling fluid through the drill string 705. A gas injector 758 may introduce non-formation gas into the drilling fluid as it is pumped into the drill string 705. Once the drilling fluid exits the drill bit 756 into annulus 758, a third pump 760, located underwater, may pump the drilling fluid to the platform 701. A extractor and analyzer may be incorporated at various locations within the system 700, including within pumps 754 and 760, in fluid communication with fluid conduits between pumps 754 and 760, or in fluid communication with fluid conduits between the pumps 754 and 760 and the drill string 705.

According to aspects of the present disclosure, an example method for determining downhole conditions in a subterranean formation during a drilling operation may include introducing non-formation gas into a flow of drilling fluid through a fluid conduit in fluid communication with a drill string disposed within a borehole in the subterranean operation. The non-formation gas may be received from the flow of drilling fluid through a return line in fluid communication with the borehole. A downhole condition may be determined based, at least in part, on the receive non-formation gas.

In certain embodiments, receiving non-formation gas comprises extracting gasses from a drilling fluid sample; determining a percentage of the extracted gas corresponding to the non-formation gas; and plotting the percentage over time. Determining the downhole condition based, at least in part, on the received non-formation gas further may comprise analyzing the plot. In certain embodiments, analyzing the plot comprises fitting the plot with at least one of a Gaussian, Lorentzian, polynomial, power law, and logarithmic equation. In certain embodiments, analyzing the plot comprises integrating the plot over a first time period. The first time period may correspond to at least one of the time in which the non-formation gas is detected and a spike in the plot. And determining the downhole condition based, at least in part, on the received non-formation gas further may comprises determining a concentration of the introduced non-formation gas in a volume of drilling fluid;

determining a concentration of the receive non-formation gas in a volume of drilling fluid based, at least in part, on the plot integration; and comparing the concentration of the introduced non-formation gas to the concentration of the received non-formation gas.

When the first time period corresponds to the time in which the non-formation gas is detected, comparing the concentration of the introduced non-formation gas to the concentration of the received non-formation gas may comprise determining a fluid loss percentage to the formation. When the first time period corresponds to the spike in the plot, comparing the concentration of the introduced non-formation gas to the concentration of the received non-formation gas may comprise identifying a wash-out in the borehole. The downhole condition may comprise at least one of a fluid loss percentage within the subterranean formation, a volume of the borehole, a volume of an annulus between the drill string and the borehole, a volume of a complete circulation through the borehole, a percentage of the borehole that is washed out or caved in, and a pump efficiency.

According to aspects of the present disclosure, an example system for determining downhole conditions in a subterranean formation during a drilling operation may comprise a gas injector containing non-formation gas in fluid communication with a flow of drilling fluid entering a borehole in the subterranean formation. A gas analyzer may be in fluid communication with a flow of drilling fluid exiting the borehole. An information handling system may be communicably coupled to the gas injector and the gas analyzer. The information handling system may comprise a processor and a memory device coupled to the processor and containing a set of instructions that, when executed by the processor, cause the processor to introduce non-formation gas into the flow of drilling fluid at the gas injector and determine a downhole condition based, at least in part, on non-formation gas received at the gas analyzer.

In certain embodiments, the gas injector may be in fluid communication with the flow of drilling fluid entering the borehole through a fluid conduit in fluid communication with a drill string within the borehole. The gas analyzer may be in fluid communication with the flow of drilling fluid exiting the borehole through a return line in fluid communication with the borehole. In certain embodiments, the set of instructions that causes the processor to determine the downhole condition based, at least in part, on non-formation gas received at the gas analyzer further may cause the processor to determine a percentage of extracted gas from a drilling fluid sample corresponding to the non-formation gas and plot the percentage over time.

The information handling system may further analyze the plot by fitting it to at least one of a Gaussian, Lorentzian, polynomial, power law, and logarithmic equation. The information handling system may further analyze the plot by integrating it over a first time period. In certain embodiments, the first time period may correspond to at least one of the time in which the non-formation gas is detected and a spike in the plot, and the information handling system may determine a concentration of the introduced non-formation gas in a volume of drilling fluid, determine a concentration of the receive non-formation gas in a volume of drilling fluid based, at least in part, on the plot integration, and compare the concentration of the introduced non-formation gas to the concentration of the received non-formation gas.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A method determining downhole conditions in a subterranean formation during a drilling operation, comprising:

introducing a non-formation gas into a downhole flow of a drilling fluid as the drilling fluid is pumped by a first pump located at a surface into a drill string disposed in a borehole, wherein the non-formation gas is introduced between the first pump and the borehole where the drilling fluid enters the borehole;

pumping, by a second pump located below the surface, the drilling fluid that has exited the drill string into an annulus between the drill string and the borehole to a fluid conduit located at the surface, wherein the fluid conduit is in fluid communication with the annulus at the surface;

receiving, at the fluid conduit, the non-formation gas extracted from the flow of the drilling fluid returned from downhole, wherein the non-formation gas is extracted from the fluid conduit upstream of a mud tank and wherein receiving the non-formation gas comprises:

extracting gasses from a drilling fluid sample; and determining a percentage of the extracted gas corresponding to the non-formation gas; and determining a downhole condition with respect to the borehole based, at least in part, on the received non-formation gas and the percentage of the extracted gas corresponding to the non-formation gas, wherein the downhole condition comprises at least a percentage of the drilling fluid that is lost to the subterranean formation.

2. The method of claim 1, wherein introducing the non-formation gas into the downhole flow of the drilling fluid comprises introducing the non-formation gas into the flow of the drilling fluid at the fluid conduit in fluid communication with the drill string disposed within the borehole in the drilling operation; and receiving the non-formation gas from the flow of the drilling fluid returned from downhole comprises receiving a sample of the drilling fluid from a return line in fluid communication with the borehole.

3. The method of claim 2, wherein the downhole condition comprises at least one of a fluid loss percentage within the subterranean formation, a volume of the borehole, a volume of an annulus between the drill string and the borehole, a volume of a complete circulation through the borehole, a percentage of the borehole that is washed out or caved in, and a pump efficiency.

4. The method of claim 1, wherein receiving the non-formation gas comprises plotting the percentage of the extracted gas corresponding to the non-formation gas over time.

5. The method of claim 4, wherein determining the downhole condition based, at least in part, on the received non-formation gas comprises analyzing the plot.

6. The method of claim 5, wherein analyzing the plot comprises fitting the plot with at least one of a Gaussian, Lorentzian, polynomial, power law, and logarithmic equation.

7. The method of claim 5, where analyzing the plot comprises integrating the plot over a first time period in which the non-formation gas is present to determine at least one of a total mass or a total volume of the non-formation gas.

8. The method of claim 7, wherein the first time period corresponds to at least one of the time in which the received non-formation gas is detected and a spike in the plot; and determining the downhole condition based, at least in part, on the received non-formation gas further comprises determining a first concentration of the non-formation gas introduced into the downhole flow in a volume of the drilling fluid;

determining a second concentration of the received non-formation gas in a volume of the drilling fluid returned from downhole based, at least in part, on the plot integration; and comparing the first concentration of the introduced non-formation gas to the second concentration of the received non-formation gas.

9. The method of claim 8, wherein the first time period corresponds to the time in which the received non-formation gas is detected; and comparing the concentration of the introduced non-formation gas to the concentration of the received non-formation gas comprises determining a fluid loss percentage to the formation.

10. The method of claim 9, wherein the first time period corresponds to the spike in the plot; and comparing the concentration of the introduced non-formation gas to the concentration of the received non-formation gas comprises identifying a wash-out in the borehole.

11. A system for determining downhole conditions in a subterranean formation during a drilling operation, comprising:

a gas injector containing a non-formation gas in fluid communication with a first flow of a drilling fluid, pumped by a first pump located at a surface, entering a borehole in the subterranean formation, wherein the gas injector is between the first pump and the borehole;

a gas analyzer in fluid communication with a fluid conduit located at the surface, wherein a second flow of the drilling fluid is pumped by a second pump located below the surface, wherein the fluid conduit is in fluid communication with an annulus of the borehole at the surface, wherein the second flow of drilling fluid is pumped by the second pump from downhole through the annulus; and an information handling system communicably coupled to the gas injector and the gas analyzer, the information handling system comprising a processor and a memory device coupled to the processor and containing a set of instructions that, when executed by the processor, cause the processor to introduce the non-formation gas into the first flow of the drilling fluid at the gas injector, wherein the non-formation gas is introduced where the drilling fluid enters the borehole;

determine a percentage of extracted gas from a drilling fluid sample corresponding to the non-formation gas; and determine a downhole condition with respect to the borehole based, at least in part, on the non-formation gas extracted from the flow of the drilling fluid returned from downhole and received at the gas analyzer and the percentage of the extracted gas corresponding to the non-formation gas, wherein the non-formation gas is extracted from the fluid conduit upstream of a mud tank, wherein the downhole condition comprises at least a percentage of the drilling fluid that is lost to the subterranean formation.

12. The system of claim 11, wherein the gas injector is in fluid communication with the first flow of drilling fluid entering the borehole through the fluid conduit in fluid communication with a drill string within the borehole; and the gas analyzer is in fluid communication with the second flow of drilling fluid exiting the borehole through a return line in fluid communication with the borehole.

13. The system of claim 12, wherein the downhole condition comprises at least one of a fluid loss percentage within the subterranean formation, a volume of the borehole, a volume of an annulus between the drill string and the borehole, a volume of a complete circulation through the borehole, a percentage of the borehole that is washed out or caved in, and a pump efficiency.

14. The system of claim 11, wherein the set of instructions that causes the processor to determine the downhole condition based, at least in part, on the non-formation gas received at the gas analyzer further causes the processor to plot the percentage of the extracted gas corresponding to the non-formation gas over time.

15. The system of claim 14, wherein the set of instructions that causes the processor to determine the downhole condition based, at least in part, on the non-formation gas received at the gas analyzer further causes the processor to analyze the plot.

16. The system of claim 15, wherein the set of instructions that causes the processor to analyze the plot further causes the processor to fit the plot to at least one of a Gaussian, Lorentzian, polynomial, power law, and logarithmic equation.

17. The system of claim 15, wherein the set of instructions that causes the processor to analyze the plot further causes the processor to integrate the plot over a first time period in which the non-formation gas is present to determine at least one of a total mass or a total volume of the non-formation gas.

18. The system of claim 17, wherein the first time period corresponds to at least one of the time in which the non-formation gas returned from downhole and received at the gas analyzer is detected and a spike in the plot; and wherein the set of instructions that causes the processor to determine the downhole condition based, at least in part, on the received non-formation gas further causes the processor to determine a first concentration of the introduced non-formation gas in a volume of the drilling fluid;

determine a second concentration of the non-formation gas returned from downhole and received at the gas analyzer in a volume of a drilling fluid sample based, at least in part, on the plot integration; and compare the first concentration of the introduced non-formation gas to the second concentration of the non-formation gas returned from downhole and received at the gas analyzer.

19. The system of claim 18, wherein the first time period corresponds to the time in which the non-formation gas returned from downhole and received at the gas analyzer is detected; and wherein the set of instructions that causes the processor to compare the concentration of the introduced non-formation gas to the concentration of the non-formation gas returned from downhole and received at the gas analyzer further causes the processor to determine a fluid loss percentage to the formation.

20. The system of claim 19, wherein the first time period corresponds to the spike in the plot; and wherein the set of instructions that causes the processor to compare the concentration of the introduced non-formation gas to the concentration of the non-formation gas returned from downhole and received at the gas analyzer further causes the processor to identify a wash-out in the borehole.

* * * * *